United States Patent [19]

John et al.

[11] Patent Number: 4,467,516

[45] Date of Patent: Aug. 28, 1984

[54] WIRE INSERTION APPARATUS

[75] Inventors: Waldemar John, High Point; John J. Tucci, Winston-Salem, both of N.C.

[73] Assignee: AMP Incorporated, Harrisburg, Pa.

[21] Appl. No.: 440,101

[22] Filed: Nov. 8, 1982

[51] Int. Cl.[3] ..... H01R 43/04

[52] U.S. Cl. ..... 29/566.4; 7/158; 29/33 M; 29/751; 29/752

[58] Field of Search ..... 29/566.4, 750, 751, 29/752, 753, 747, 748, 33 M, 566.1, 566.2, 566.3; 7/130, 131, 133, 134, 138

[56] References Cited

U.S. PATENT DOCUMENTS

| | | | |
|---|---|---|---|
| 3,742,571 | 7/1973 | Brehm | 29/751 X |
| 4,387,501 | 6/1983 | Rix | 29/566.4 |
| 4,389,769 | 6/1983 | Casey | 29/751 |

*Primary Examiner*—Z. R. Bilinsky
*Attorney, Agent, or Firm*—Robert Usher

[57] ABSTRACT

Apparatus for inserting wires into terminals on opposite sides of an elecrical connector in a single stroke comprising first and second wire insertion heads mounted on respective opposite sides of a connector holder which includes a slide mounted on an anvil and linked to an insertion ram carrying the first wire insertion head so that wire insertion movement of the insertion ram relative to the holder produces corresponding movement of the slide.

5 Claims, 7 Drawing Figures

WIRE INSERTION APPARATUS

The invention relates to wire insertion apparatus and more particularly to apparatus for severing and inserting wires into terminals mounted in an electrical connector housing.

It is often required to insert wires into terminals mounted in electrical connector housings; for example, those described in U.S. Pat. No. 4,335,929 in which two rows of terminals each having wire-receiving slots are mounted along respective opposite longitudinal sides of an insulating housing.

An example of prior wire insertion apparatus used with such housings is disclosed in U.S. Pat. No. 3,742,571.

However, a disadvantage of such prior apparatus is that a single operation of the wire insertion ram can insert a wire into a terminal on only one side of the connector housing. In order to insert a second wire, (usually the second of a matched pair of wires), into an associated terminal on the other side of the housing, it is necessary to remove the housing from the holder, rotate the housing through 180°, reinsert the housing and locate the associated terminal opposite the insertion ram. It is then necessary to select the other wire of the matched pair and align it with the insertion ram. This may be a time consuming procedure and difficulty may be experienced in manipulating the wires during removal of the housing from the holder, rotation, and reinsertion into the holder.

It is more convenient, for some applications, to achieve simultaneous insertion of one or more matched pairs of wires into corresponding terminals located on opposite sides of the housing.

An object of the invention is to provide apparatus for inserting simultaneously first and second wires into respective terminals located on opposite sides of an electrical connector housing.

A further object of the invention is to provide such apparatus which is reliable in use and uses a minimum number of moving parts.

An additional object of the invention is to provide such apparatus which equalizes wire insertion forces applied to opposite sides of the connector housing to minimize the risk of strain and consequential damage to the connector housing and terminals and assist in ensuring reliable wire connection to the terminals.

Another object of the invention is to provide such apparatus which requires minimum modification of existing apparatus to minimize retooling expenses.

According to the invention, there is provided apparatus for inserting wires into terminals mounted on opposite sides of an electrical connector comprising a connector holder including an anvil, a wire insertion ram having a first wire insertion head mounted on one side of the anvil for reciprocation towards and away from a connector when in the connector holder to insert a wire into a terminal on one side of the connector adjacent the wire insertion ram, means being provided to effect reciprocation of the insertion ram, the improvement comprising a second wire insertion head mounted on the other side of the anvil aligned with the first wire insertion head and a connector holder including a connector supporting slide mounted on the anvil between both wire insertion heads for reciprocal sliding movement towards and away from the second wire insertion head during corresponding movement of the wire insertion ram.

Preferably, the apparatus includes a linkage between the slide and the insertion ram enabling return movement of the insertion ram away from the second wire insertion head to effect corresponding movement of the slide.

Desirably, the linkage comprises a first blind ended slot in the slide and a first pin fixed on the insertion ram freely received in the first slot, to permit lost motion between the insertion ram and the slide, one blind end of the first slot being engageable by the first pin during return movement of the insertion ram to effect the corresponding movement of the slide.

More specifically, a second blind ended slot is formed in the slide and a second pin is fixed on the anvil adjacent the second wire insertion head and is freely received in the second slot to permit lost motion between the anvil and the slide, the ends of the slot being engageable by the pin to limit the movement of the slide.

An example of the wire insertion apparatus according to the insertion will now be described with reference to the accompanying drawings in which.

Figure 1:
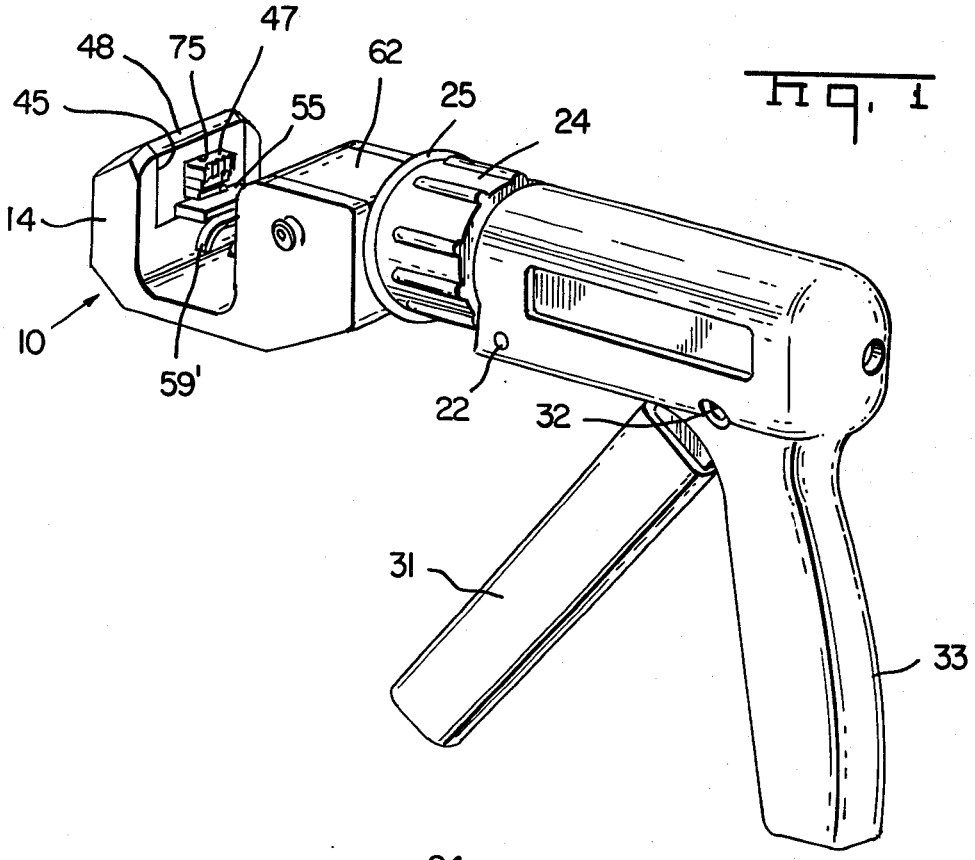
FIG. 1 is a perspective view of the apparatus.
Figure 2:
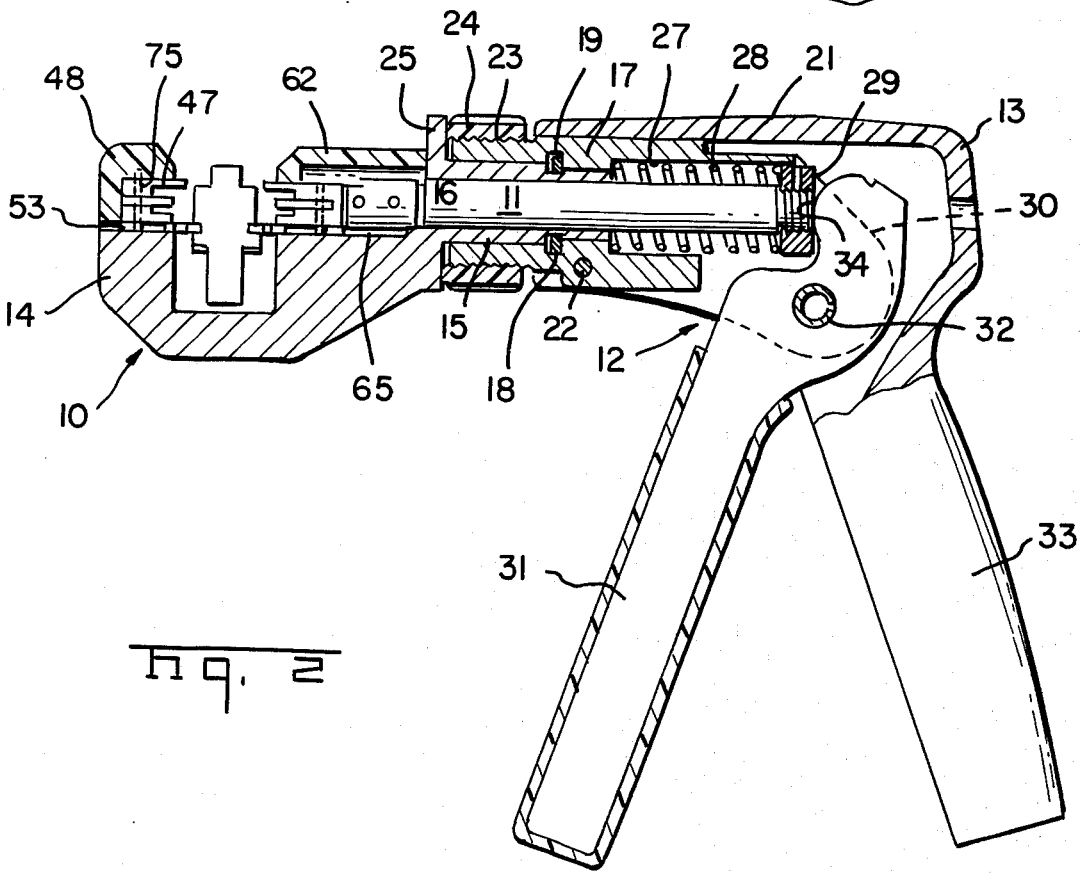
FIG. 2 is a side elevation of the apparatus partly in cross-section.

The wire insertion apparatus comprises a connector holder 10, a wire insertion ram 11 mounted for reciprocation on the connector holder and an operating mechanism 12 for the insertion ram enclosed in a pistol-grip type housing 13. The housing and operating mechanism is similar to that described in U.S. Pat. No. 3,742,571 the disclosure of which is incorporated herein by reference.

The connector holder includes a channel section anvil block 14 formed with a lateral extension 15 having an internal bore 16 which receives the insertion ram 11 in a sliding fit and which is secured in a bush 17 by a circlip 18 mounted in an internal annular groove 19 in the bush. The bush 17 is secured in a stock portion 21 of the housing 13 by a pin 22 and has an externally threaded forward end 23 carrying a lock nut 24 which bears against a flange 25 on the extension 15. The bush 17 is formed with a counterbore 27 at a rear end and a pair of spaced apart rearwardly projecting ears 30 housing a return spring 28 which is trapped against a retaining nut 24 mounted as a screw fit on a rear end of insertion ram 11. The insertion ram operating mechanism 12 includes a lever trigger 31 pivotally mounted at 32 in the stock portion 21 adjacent a handle 33 with a curved actuating end 34 of the lever bearing against the rear end of the insertion ram.

Figure 3:
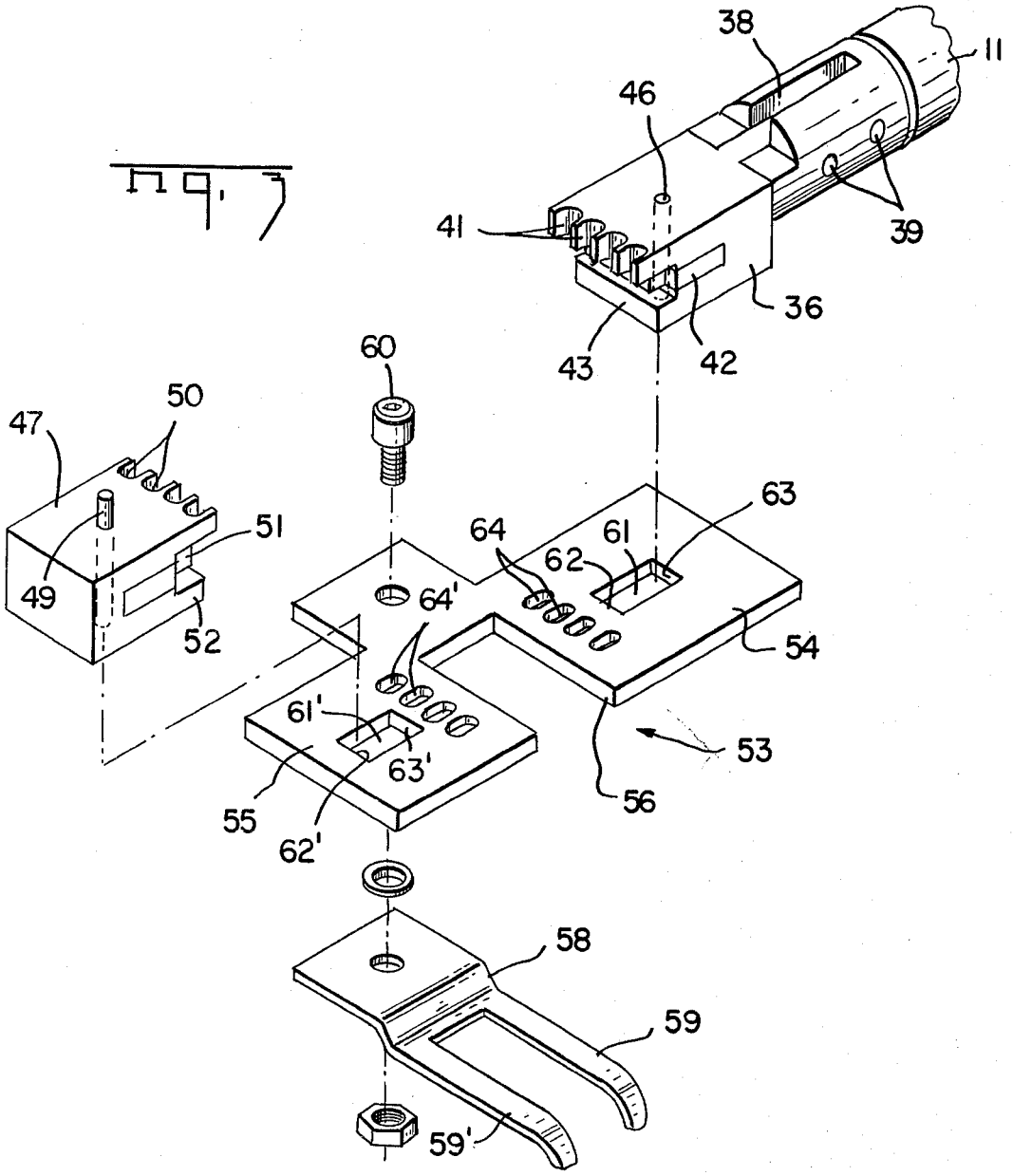
FIG. 3 is an exploded, fragmentary view of a connector supporting slide and wire insertion heads of the apparatus.
Figure 7:
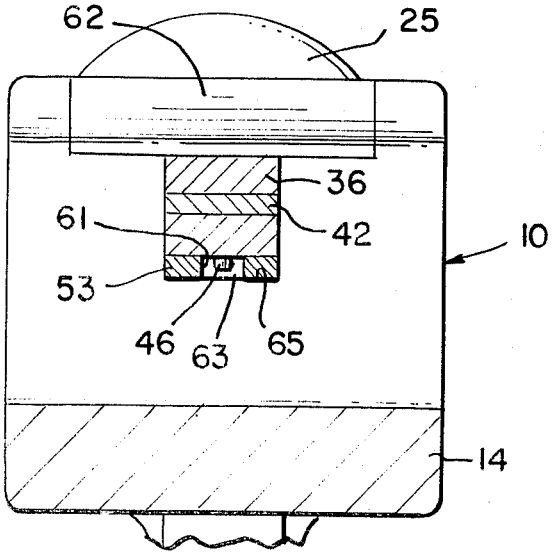

A first wire insertion head 36 is mounted in a clevis 38 on a front end of the insertion ram adjacent one side of the channel by pins 39. As shown particularly in FIG. 3, a wire engaging end of the head is formed with a series of U-section wire guides 41, wire stuffers 42 below the guides and a shear plate 43 below the wire stuffers. A link pin 46 is secured in the head with a lower end projecting vertically downwardly therefrom.

A second wire insertion head 47, similar to the first, is fixed by a pin 49 in a plastic block 48 secured in a cutout 45 in the other side on the anvil block opposite the insertion ram. A wire engaging end of the wire insertion head is also formed with wire guides 50, a wire stuffer 51 and a wire shear plate 52 opposite corresponding parts in the first head.

The connector holder includes a planar connector supporting slide 53 comprising first and second plate portions 54 and 55 respectively, on each side of a connector receiving recess 56 and a third, mounting plate portion 57 joining the first and second plate portion. A bifurcated mounting clip 58 having spaced apart connector gripping fingers 59 is secured to the underside of plate portion 57 by a nut and bolt 60 so that the fingers extend adjacent opposite sides of the recess 56. The first and second plate portions 54 and 55 are respectively formed with slots 61 and 61' aligned axially of the insertion ram 11 and having respectively, blind forward and rear ends 62 and 62'; 63 and 63'. Rows of aigned wire receiving apertures 64 and 64' are formed in respective plate portions on each side of the recess 56, each aperture being in a vertical plane aligned with a corresponding guide 41.

The first plate portion 54 of the slide 53 is mounted in a groove 65 formed on one side of the anvil below the insertion ram with link pin 46 registering in slot 61 while the second plate portion is mounted on the other side of the anvil block in a central recess 75 in the plastic block 48 with pin 49 registering in slot 61'. A plastic housing 62 is secured to one side of the anvil shrouding the ram.

An electrical connector 81 for use with the apparatus is described in U.S. Pat. No. 4,335,929, the disclosure of which is incorporated herein by reference. The connector is shown schematically in the accompanying drawings and comprises an insulating housing on respective opposite sides of which are rows of terminals indicated at 82, 82' each having a wire receiving slot. Laterally projecting ribs 83, 83' are formed adjacent a mating end of the connector.

Figure 4:
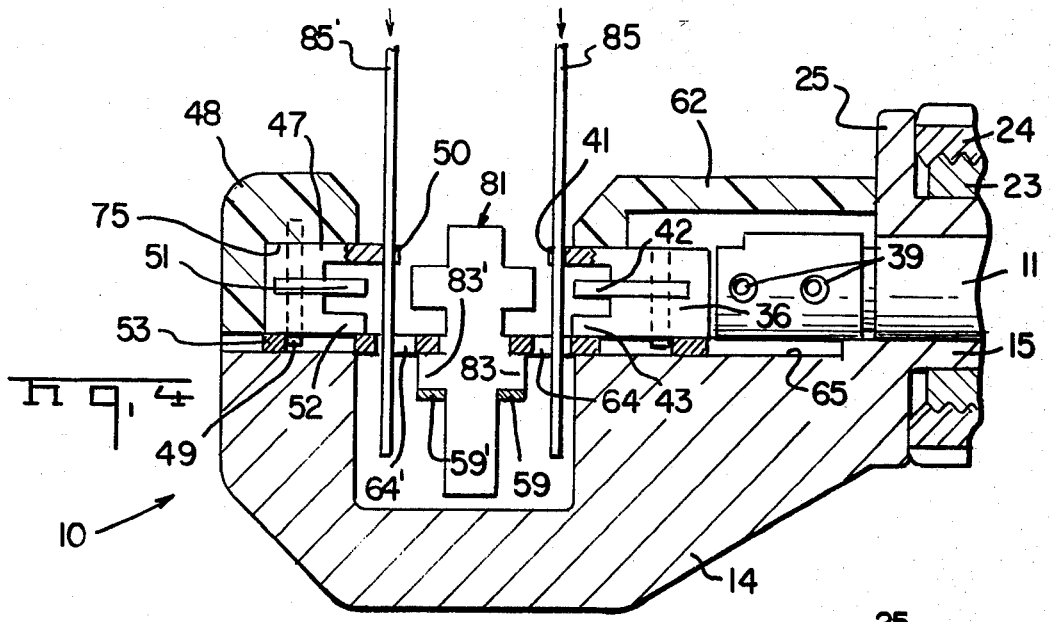
FIGS. 4 to 6 are cross-sectional views of a connector holder of the apparatus at successive stages of operation to effect wire insertion; and, FIG. 7 is a cross-sectional view taken along lines VII—VII of FIG. 5.
Figure 5:
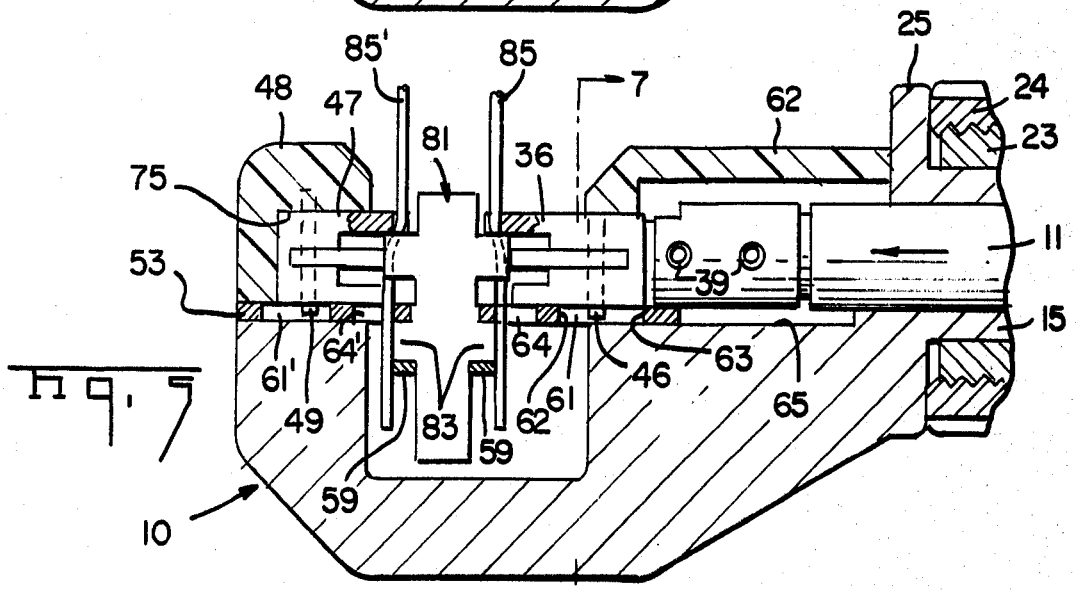

In use of the apparatus, as shown in FIG. 4, the connector is located to extend through the recess 56 with the terminals aligned with the respective stuffers 42 and 51 by the spring fingers 59, 59' clamping the ribs 83, 83' against the edge portions of the recess. Individual wires 85, 85' of pairs of wires are located in respective guides 41 and 50 and aligned apertures 64 and 64' and the lever trigger squeezed to advance the insertion ram against the action of return spring 28. As shown in FIG. 5, during the initial stages of insertion ram movement, the head 36 urges the wires 85 against terminals on one side of the connector causing the connector and slide 53 to advance towards the other head 47 with consequential flexure of both wires 85 and 85' into mouths of the corresponding terminal slots. Pins 46 and 49 moving freely along slots 61 and 61' prior to insertion of the wires into the slots permitting lost motion between the insertion ram and slide.

Figure 6:
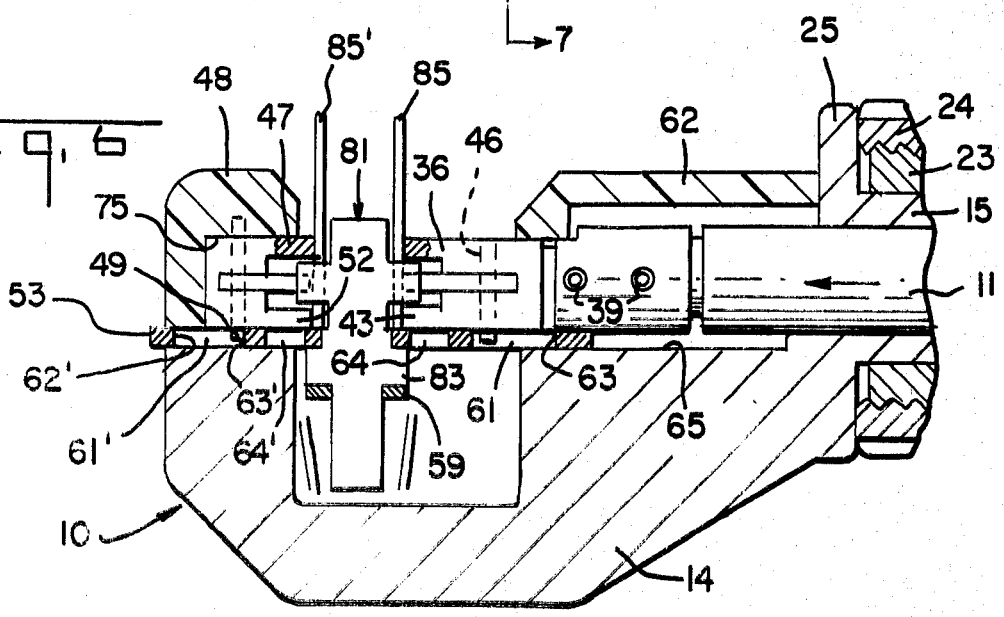

As shown in FIG. 6, further advance of the insertion ram causes the stuffers to insert the wires into the slots and the shear plates to shear the wires in cooperation with shear edges formed on edges of apertures 64 and 64'. Advance movement of the slide is limited by engagement of the blind end 63' of slot 61' with the pin 49 and subsequent advance movement of the insertion ram may be limited by engagement of pin 46 with blind end 62 of slot 61.

Release of the lever trigger permits withdrawal of the insertion ram by the action of return spring 28, initially without movement of the slide, pin 46 moving freely along slot 61. The slide and connector are subsequently also withdrawn by engagement between pin 47 and blind end 63 of slot 61. Engagement between pin 49 and blind end 62' of slot 61' limits withdrawal of the slide and insertion ram when the condition of FIG. 4 is obtained.

Advantages of the apparatus are that wires are terminated in rows of terminals on opposite sides of the connector, simultaneously avoiding a need to manipulate the connector during wire insertion. In addition, the wire insertion forces applied to opposite sides of the housing are essentially balanced. These advantages are obtained by relatively little modification of the prior apparatus avoiding a need for extensive redesign and retooling.

We claim:

1. Apparatus for inserting wires into terminals mounted on opposite sides of an electrical connector comprising a connector holder including an anvil, wire insertion ram having a first wire insertion head mounted on one side of the anvil for reciprocation towards and away from a connector when in the connector holder to insert a wire into a terminal on one side of the connector adjacent the wire insertion ram, means being provided to effect reciprocation of the insertion ram, the improvement comprising a second wire insertion head mounted on the other side of the anvil aligned with the first wire insertion head, the connector holder including a connector supporting slide mounted on the anvil between both wire insertion heads for reciprocal sliding movement towards and away from the second wire insertion head during corresponding movement of the wire insertion ram, a linkage between the slide and the insertion ram enabling return movement of the insertion ram away from the second wire insertion head to effect corresponding movement of the slide.

2. Apparatus according to claim 1 in which the linkage comprises a first blind ended slot in the slide and a first pin fixed on the insertion ram freely received in the first slot to permit lost motion between the insertion ram and the slide, one blind end of the first slot being engageable by the first pin during return movement of the insertion ram to effect the corresponding movement of the slide.

3. Apparatus according to claim 2, in which a second blind ended slot is formed in the slide and a second pin is fixed on the anvil adjacent the second wire insertion head and is freely received in the second slot to permit lost motion between the anvil and the slide, the blind ends of the second slot being engageable by the pin to limit the movement of the slide.

4. Apparatus according to claim 2 in which wire locating slots having wire shearing edges are formed in the slide on each side of a connector supporting portion, the slots having wire shearing edges for engagement with wire shearing edges provided on the wire insertion rams during forward movement of the insertion ram.

5. Apparatus according to claim 1 in which the slide is formed with a connector locating recess and a clip is provided to secure the connector in the recess.

* * * * *